United States Patent [19]

Scopatz

[11] Patent Number: 4,645,080

[45] Date of Patent: Feb. 24, 1987

[54] METHOD AND APPARATUS FOR GRADING NON-ORIENTING ARTICLES

[75] Inventor: Stephen D. Scopatz, Three Rivers, Calif.

[73] Assignee: Pennwalt Corporation, Philadelphia, Pa.

[21] Appl. No.: 626,577

[22] Filed: Jul. 2, 1984

[51] Int. Cl.[4] ..... B07C 5/342

[52] U.S. Cl. ..... 209/558; 209/587; 209/701; 209/939; 250/223 R; 358/106

[58] Field of Search ..... 209/555, 556, 558, 587, 209/701, 939; 358/106; 250/223 R; 356/426; 364/559, 507

[56] References Cited

U.S. PATENT DOCUMENTS

| | | | |
|---|---|---|---|
| 4,122,951 | 10/1978 | Alaminos | 209/939 X |
| 4,246,098 | 1/1981 | Conway et al. | 209/558 |
| 4,486,775 | 12/1984 | Catlow | 358/106 |

FOREIGN PATENT DOCUMENTS

| | | | |
|---|---|---|---|
| 2126356 | 3/1984 | United Kingdom | 209/586 |

OTHER PUBLICATIONS

Advertisement from p. 91 of the Jun. 1983 edition of Food Processing.

*Primary Examiner*—Robert B. Reeves
*Assistant Examiner*—Edward M. Wacyra
*Attorney, Agent, or Firm*—Seidel, Gonda, Goldhammer & Abbott

[57] ABSTRACT

A method and apparatus for grading generally spherical articles, and specifically fruit such a oranges, which do not orient along a predetermined axis when rotated on a roller conveyor comprises a pair of side scan cameras disposed on opposite sides of the fruit. An overhead camera provides plural data signals representative of the surface quality of the fruit. The side scan cameras provide data indicative of the surface quality of side portions of the fruit. A processor and processing algorithm computes a surface quality indication based upon the data from the overhead camera and modifies the surface quality indication depending upon the data provided by the side scan cameras.

13 Claims, 9 Drawing Figures

FIG. 1
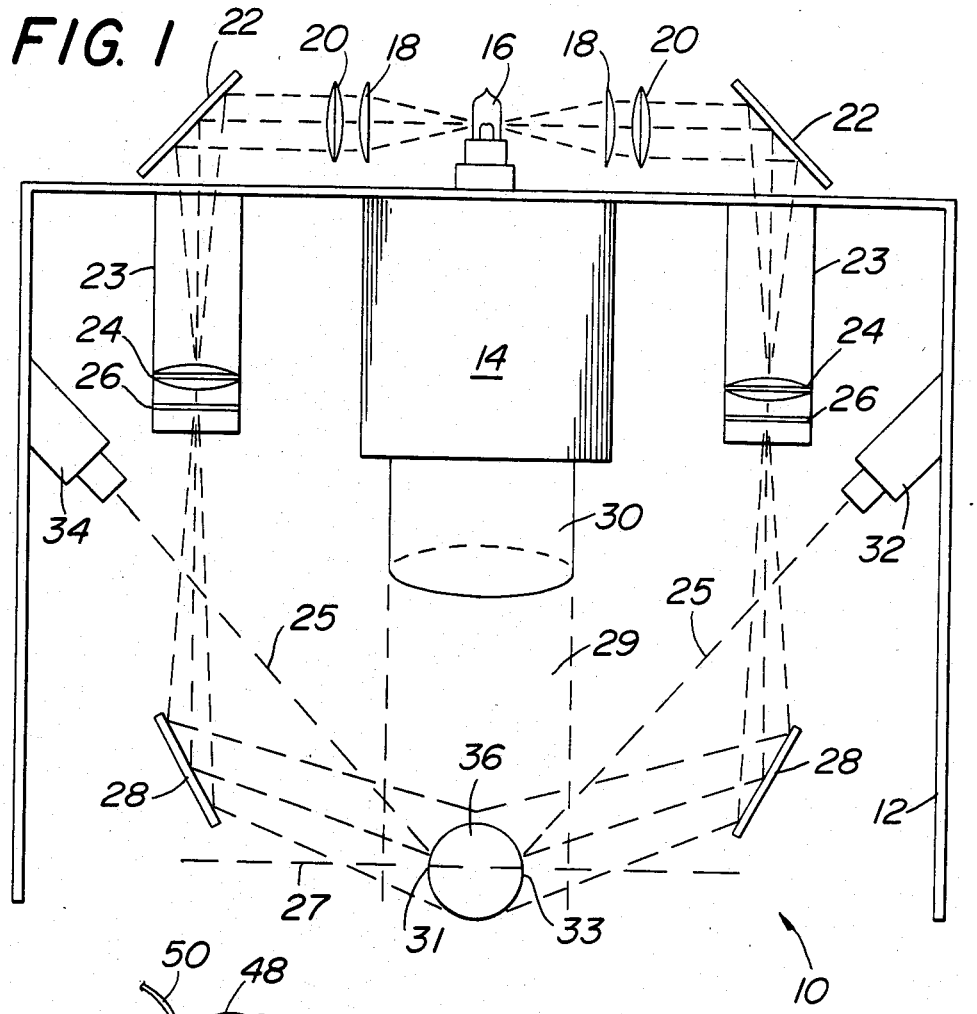
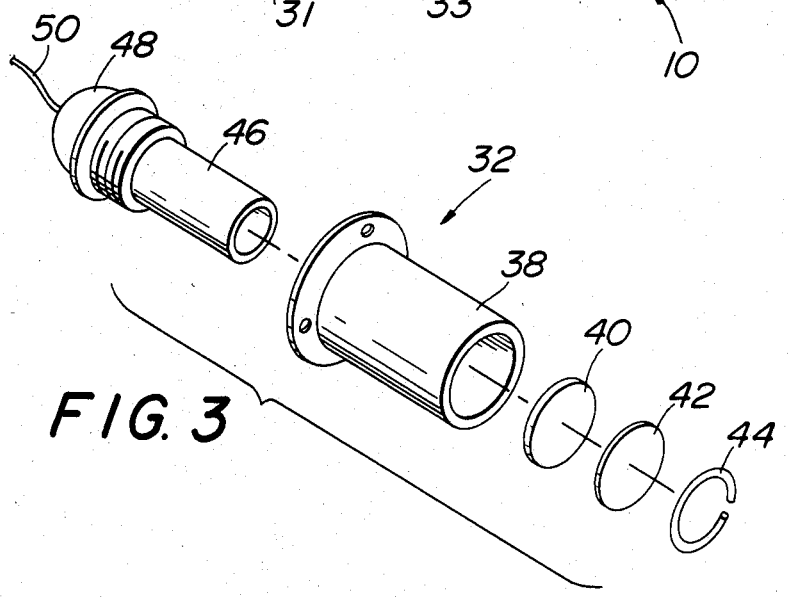
FIG. 3

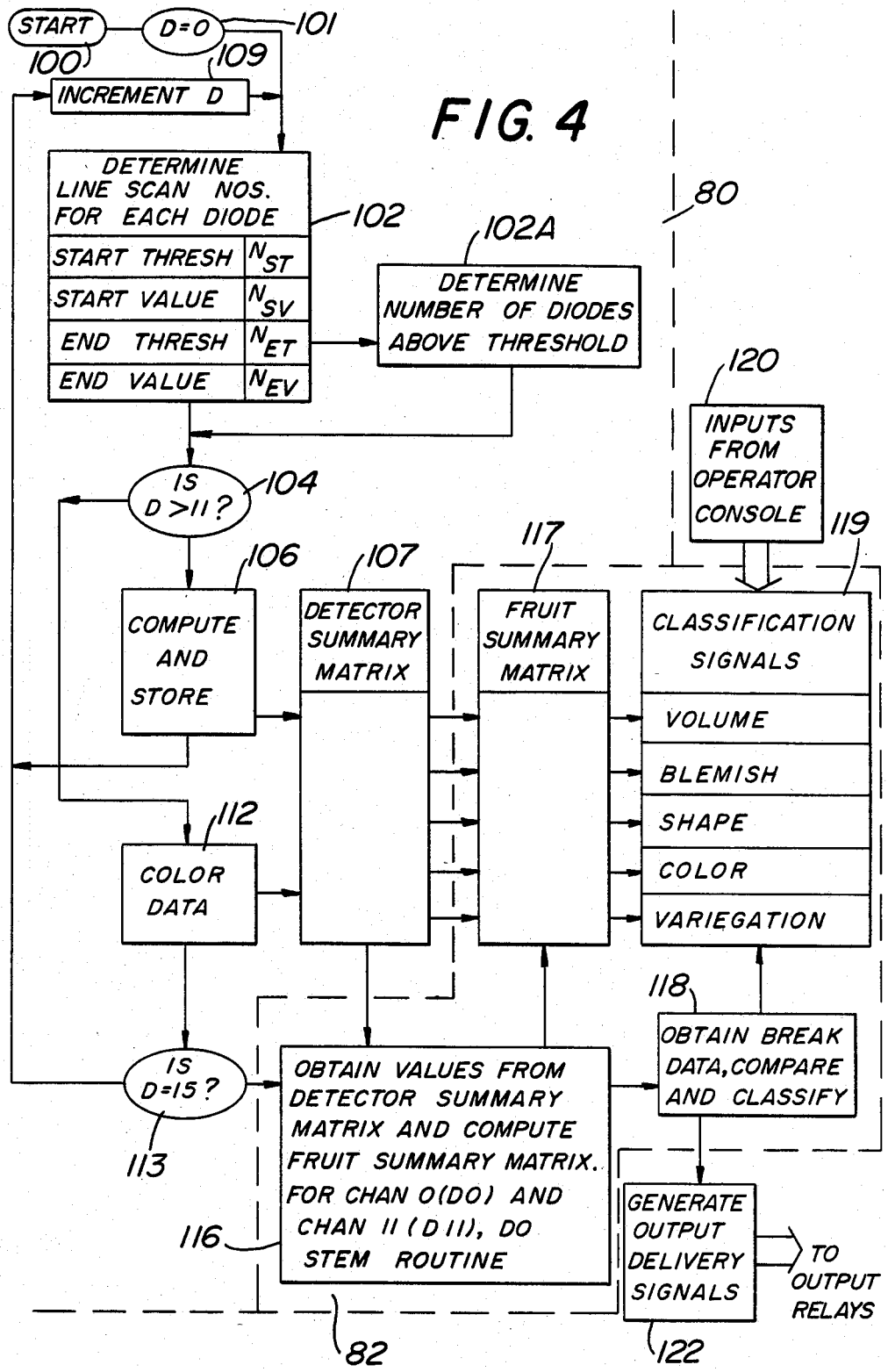
START
D=0
101
100
109
INCREMENT D
FIG. 4
DETERMINE LINE SCAN NOS. FOR EACH DIODE
102
START THRESH
$N_{ST}$
START VALUE
$N_{SV}$
END THRESH
$N_{ET}$
END VALUE
$N_{EV}$
102A
DETERMINE NUMBER OF DIODES ABOVE THRESHOLD
80
120
INPUTS FROM OPERATOR CONSOLE
IS D>11?
104
119
117
106
107
COMPUTE AND STORE
DETECTOR SUMMARY MATRIX
FRUIT SUMMARY MATRIX
CLASSIFICATION SIGNALS
VOLUME
BLEMISH
SHAPE
COLOR
VARIEGATION
112
COLOR DATA
118
OBTAIN BREAK DATA, COMPARE AND CLASSIFY
IS D=15?
113
OBTAIN VALUES FROM DETECTOR SUMMARY MATRIX AND COMPUTE FRUIT SUMMARY MATRIX. FOR CHAN O(DO) AND CHAN 11 (D11), DO STEM ROUTINE
116
GENERATE OUTPUT DELIVERY SIGNALS
TO OUTPUT RELAYS
82
122

DIGITAL VALUE OF LIGHT SIGNAL
260
240
220
200
180
160
140
120
100
80
60
40
20
0
10
20
30
40
50
60
70
80
90
100
$N_{ST}$
$N_{SV}$
$N_{EV}$
$N_{ET}$
LINE SCAN NUMBER (N)

STEM
124
GET CHAN 0 (D0) AND CHAN 11 (D11) DATA (SIDE SCAN DATA) FROM DETECTOR SUMMARY MATRIX
126

SUM ALL CHAN 0 (D 0) AND CHAN 11(D 11) DATA FOR ALL N SCANS TOGETHER
128
130
140
AVG. BLEMISH
STEM THRESHOLD

METHOD AND APPARATUS FOR GRADING NON-ORIENTING ARTICLES

BACKGROUND OF THE INVENTION

The present invention relates to an apparatus and method for processing articles, and particularly non-orienting fruit such as oranges, according to a surface characteristic such as blemish. More particularly, the present invention is an improvement over the apparatus and method for sorting fruit according to color, surface blemish, size and/or shape disclosed in U.S. patent application Ser. No. 430,068, filed Sept. 30, 1982, now U.S. Pat. No. 4,515,275 entitled "Apparatus and Method for Processing Fruit and Like", incorporated herein by reference. Also incorporated herein by reference is U.S. patent application Ser. No. 430,083, filed Sept. 30, 1982, entitled "Apparatus for Spinning Fruit for Sorting Thereof" which discloses apparatus for transporting fruit through a fruit examining region and spinning the fruit while it is in the fruit examining region so as to present substantially the entire surface of the fruit to overhead examining devices, such as video cameras.

The aforementioned U.S. patent applications are collectively directed to an apparatus for soring generally elongated fruit such as lemons which automatically orient themselves along a predetermined axis when they are spun on the roller conveyor disclosed in aforementioned U.S. patent application Ser. No. 430,083. When a lemon is spun on the roller conveyor disclosed therein, the stem and blossom ends thereof automatically orient along a substantially horizontal axis. The overhead viewing camera disclosed in aforementioned U.S. patent application Ser. No. 430,068 therefore does not mistake the stem and blossom ends of the lemon for a blemish.

A problem with the fruit processing apparatus and method disclosed in aforementioned U.S. patent application Ser. No. 430,068 and the spinning apparatus disclosed in aforementioned U.S. patent application Ser. No. 430,083 is that they do not lend themselves to sorting generally spherical fruit, such as oranges and grapefruits. Such fruit does not automatically orient along a predetermined axis when it is spun on the roller conveyor. Thus, it is possible that generally spherical fruit will orient in such a manner that the stem and blossom ends thereof will be presented to the viewing camera and will be mistaken for surface blemish.

It is desirable to provide a means for determining the orientation of generally spherical fruit which does not orient along a predetermined axis when it is rotated and which is usable in connection with the apparatus and method disclosed in aforementioned U.S. patent applications Ser. Nos. 430,068 and 430,083. Preferably, such means should provide fruit orientation information to the processing apparatus disclosed in U.S. patent application Ser. No. 430,068 so that processing of the fruit surface characteristic data may be altered according to the orientation of the fruit.

SUMMARY OF THE INVENTION

Apparatus for sorting generally spherical articles, and particularly fruit such as oranges and grapefruit, according to a surface condition, comprises a roller conveyor simultaneously transporting and spinning the article to be sorted through an examining region. A light source and optics illuminate the article while it is in the examining region. A first video camera comprises a linear photodiode array disposed in the examining region overhead the path of the article and has a relatively narrow field of view which falls in a substantially vertical plane that is perpendicular to and intersected by the path of the article. Each diode in the linear diode array receives light reflected from a portion of the surface of the article and provides a signal having a value representative of a surface condition of the respective portion of the article.

Second and third video cameras are disposed adjacent to and on opposite sides of the roller conveyor and receive light reflected from side portions of the surface of the article. The fields of view of the second and third video cameras are in substantially the same plane as the field of view of the first video camera. The second and third video cameras each comprise a photodiode providing data signals having values representative of the surface condition of the side portions of the article.

A multiplexer receives the data from the first, second and third video cameras and provides a multiplexed video output signal to an analog to digital converter which converts the video output signal to digital data signals. A processor computes an initial value, called a "preliminary blemish figure" indicative of the surface condition, i.e., the amount of blemish, on the surface of the article, based upon the data received from the first video camera. The processor modifies the preliminary blemish figure, according to the data received from the second and third video cameras. The modified blemish figure is a closer indication of the actual surface condition or surface quality of the article. The modified blemish figure is used by the processor to determine where the article should be discharged.

BRIEF DESCRIPTION OF THE DRAWINGS

FIG. 1 is a schematic elevational view illustrating the various components used in practicing the present invention.

FIG. 3 is an exploded view of one of the video cameras used in the practice of the present invention.

FIG. 4 is a flow diagram illustrating the operation of a portion of the processing method of the present invention.

DETAILED DESCRIPTION OF THE INVENTION

Figure 2:
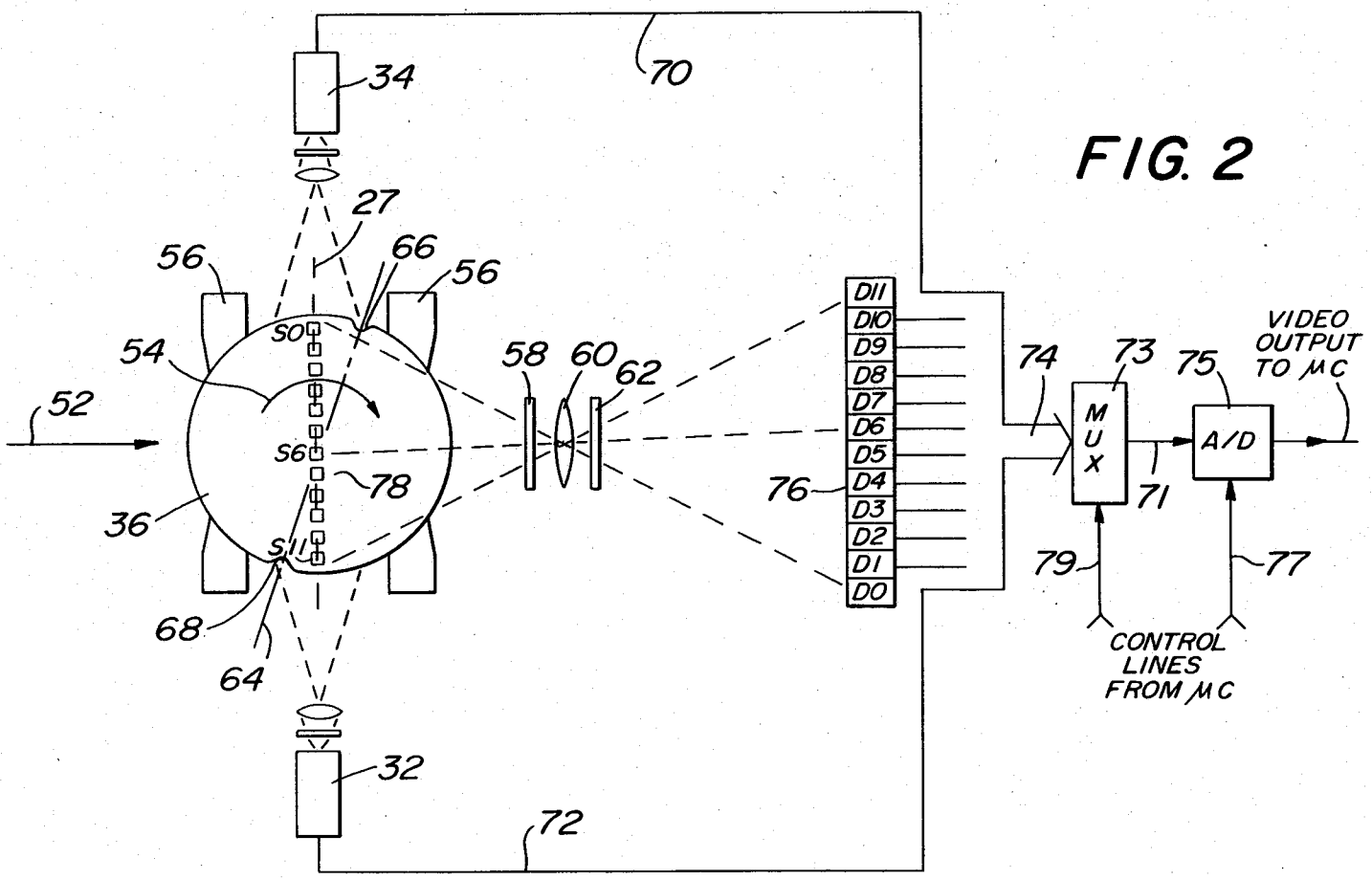
FIG. 2 is a schematic plan view of the video camera systems used in the practice of the present invention.

Referring now to the drawings, wherein like numerals represent like elements, there is illustrated in FIG. 1 a viewing assembly associated with an article sorting machine, labelled generally 10. Viewing assembly 10 comprises a chassis 12 and an overhead or first video camera 14. Viewing assembly 10 also includes an illumination subsystem comprising a lamp 16 which is used in common with a plurality of mirrors 22 to effectively provide illuminators 23. Illuminators 23 provide sources of light which are incident upon an article 36 which is being transported through an examining region by means of roller conveyor 56 (see FIG. 2). Light from lamp 16 passes through a condensor comprising lenses 18, 20 and is reflected at substantially right angles from mirrors 22. The reflection from mirrors 22 is passed through projection lens 24 and linear polarizing filters 26 to mirrors 28. Mirrors 28 are arranged at an angle to reflect light onto the article or fruit 36 at a desired incident angle. In the preferred embodiment, the incident angle is in the range of 15°–45° as measured from the horizontal axis 27, and is preferably 24°.

The fruit or article 36 (hereinafter referred to generally as "fruit", but not limited thereto) is rotated as it is transported beneath camera 14 by the means more fully described in the aforementioned patent application Ser. No. 430,083. Briefly, roller conveyor 56 simultaneously transports the fruit through the examining region (i.e., under cameras 14, 32 and 34) and spins the fruit about its horizontal axis 27. Thus, in the course of examining a single article or fruit 36, substantially all portions of the surface are illuminated uniformly and camera 14 scans substantially the entire surface of the fruit or article 36.

The viewing assembly 10 also comprises second and third video cameras 32, 34 respectively. First and second video cameras 32, 34, also referred to herein as "side scan" cameras, are disposed adjacent to and on opposite sides of the roller conveyor 56. See FIG. 2. Preferably, cameras 32, 34 are mounted on the chassis 12 such that their field of view is substantilly along a line 25. Preferably, the angle between the horizontal axis 27 of article 36 and the line 25 is 45°.

As explained in more detail in aformentioned U.S. patent application Ser. No. 430,068, the overhead camera 14 comprises a linear diode array 76 (FIG. 2) arranged over the fruit 36 being transported through the examining region. The field of view of overhead camera 14 is narrow and falls in a substantially vertical plane 29. The side scan cameras 32, 34 are aligned with overhead camera 14 so that their field of view also falls in the plane 29. It will be appreciated that the path of the fruit 36 is perpendicular to plane 29 and that the fruit 36 intersects the plane 29 as it is transported through the examining region. As more fully explained in aforementioned U.S. patent application Ser. No. 430,068, overhead camera 14 scans the upper surface of the fruit presented to camera 14. Side scan cameras 32, 34 scan side portions 31, 33 not visible to overhead camera 14. Stated otherwise, and as will be apparent from examination of FIG. 2, side scan cameras 32, 34 receive light reflected from portions 31, 33 of the surface of the fruit 36 that intersect the plane 29 and which portions are substantially perpendicular to the horizontal axis 27 of the article 36. It will also be appreciated that although there are an infinite number of horizontal axes of fruit 36, the horizontal axis referred to in this case is the horizontal axis 27 which is perpendicular to the direction of travel 52 of the fruit 36.

The details of side scan cameras 32, 34 are illustrated in FIG. 3. Side scan cameras 32 and 34 are identical, so only the details of side scan camera 32 are discussed herein.

Referring to FIG. 3, side scan camera 32 comprises a hollow housing 38. The light receiving end of scanning camera 32 has mounted therein a lens 40, a filter 42 and a split ring washer 44 holding the lens 40 and filter 42 in place. The opposite end of housing 32 receives a photodiode housing 46. Photodiode housing 46 comprises a photodiode 48 and a pair of conductors 50 over which video data from photodiode 48 is communicated. It will thus be appreciated that light reflected from side portions of the fruit 36 is directed through the housing 38 and into the housing 46 where it is focused upon photodiode 48 by action of lens 40. Photodiode 48 produces an analog output signal having a magnitude indicative of the light intensity incident thereon.

Referring now to FIG. 2, additional details of the viewing camera 14 and side scan cameras 32, 34 will be discussed.

As explained in more detail in aforementioned U.S. patent application Ser. No. 430,068, overhead camera 14 comprises a linear diode array 76 which, in the preferred embodiment, comprises 12 linearly arranged diodes D0–D11. Light reflected from discrete portions of the surface of the fruit 36 is directed by means of lens 60 onto the diodes D0–D11. Filters 58 and 62 are also provided, as explained in more detail in the aforementioned pending patent application. It will be appreciated that the diodes D0–D11 receive light reflected from corresponding segmental areas 78 of the fruit 36, and more specifically, segmental areas S0–S11. Thus, light reflected from a segmental area S0 is directed onto a corresponding diode D0. Similarly, light reflected from a segmental area or portion S6 is directed onto diode D6 and light reflected from segmental area or portion S11 is directed onto diode D11. As also discussed in the aforementioned pending patent application, it will be appreciated that, as roller conveyor 56 simultaneously rotates fruit in the direction shown by arrow 54, and transports it in the direction shown by arrow 52, substantially the entire surface of fruit 36 will be examined by the diodes 76. Again, as more fully explained in U.S. patent application Ser. No. 430,068, the data provided by diodes D0–D11 is provided to a multiplexer 73 via bus 74. Multiplexer 73, operating under control of a microcomputer via control lines 79, regularly scans the diodes D0–D11, thus effectively scanning the surface portions S0–S11 of the fruit 36. The multiplexed data or video output signal 71 is provided to an analog to digital converter 75, also operating under control of a microcomputer via control lines 77. Each byte provided by analog to digital converter 75 corresponds to one of the diodes D0–D11. As more fully explained in U.S. patent application Ser. No. 430,068, the bytes for each scan are stored in a memory. Thus, after a fruit 36 has passed through the examining region, there is stored in the memory digital data representative of the surface quality of substantially the entire surface of the fruit.

According to the present invention, the above-described apparatus is modified to accomodate the side scan cameras 32, 34 as will now be explained. Each side scan camera 32, 34 comprises a single photodiode output which is provided to multiplexer 73 on conductors 70, 72 respectively. In the preferred embodiment, the outputs from diodes D0 and D11 are disconnected from the input to multiplexer 73 and the outputs from side scan cameras 32, 34 are substituted therefore. Thus, channel 0 of the multiplexer 73, which previously was dedicated to diode D0 of linear array 76 is now dedicated to side scan camera 32. Similarly, channel 11 of the multiplexer, which was previously dedicated to diode D11 of linear diode array 76 is now dedicated to side scan camera 34. Diodes D1–D10 of linear array 76 are provided to channels 1–10 of multiplexer 73 via bus 74. It will be appreciated that the output of linear diode array 76 need not be modified in the manner herein described, but that additional input channels could be provided on multiplexer 73 to accomodate the data from the side scan cameras.

As shown in FIG. 2, the fruit 36 such as an orange or grapefruit is generally spherical and has a stem end 66 and a blossom end 68. The orientation of fruit 36 is defined by an imaginary line 64 passing through the stem end 66 and blossom end 68. Thus, depending upon the width of the field of view of cameras 32, 34 and the orientation of the fruit 36 (i.e., the angle between imaginary line 64 and the horizontal axis 27 of the fruit) side scan cameras 32, 34 may or may not view the stem and blossom ends 66, 68 of fruit 36. As shown in FIG. 2, the fruit 36 is oriented so that the stem end 66 and blossom end 68 are within the field of view of side scan cameras 32, 34. It will be appreciated that, when the stem end 66 and blossom end 68 are in the field of view of side scan cameras 32, 34 the overhead camera 14 will not view the stem end 66 and blossom end 68. Thus, with stem end 66 and blossom end 68 in the field of view of cameras 32, 34, less light will be reflected from the stem end 66 and blossom end 68 than from the other portions of the fruit 36 viewed by the side scan cameras 32, 34. Since the output of photodiodes 48 in side scan cameras 32, 34 will vary according to the amount of reflected light received, the cumulative data provided by the cameras 32, 34 during a scan of the fruit 36 will be indicative of the orientation of fruit 36. That is, the cumulative data from cameras 32, 34 is a direct indication whether the stem and blossom ends 66, 68 are oriented within the field of view of cameras 32, 34.

It is possible that fruit 36 may be oriented so that the stem and blossom ends 66, 68 are not within the field of view of side scan cameras 32, 34. In such event, side scan cameras 32, 34 will not view the stem end 66 or blossom end 68 during the fruit's rotation, and hence the data supplied by cameras 32, 34 will be nearly constant, there being no stem end or blossom end to alter the amount of reflected light. However, video camera 14 will view stem end 66 and blossom end 68 and is likely to mistake the stem end 66 and blossom end 68 as a blemish. Special processing techniques are provided to modify the data provided by video camera 14 (i.e., the data provided by diodes D1–D10) according to the data provided by side scan cameras 32, 34. Thus, if side scan cameras 32, 34 view the stem and blossom ends, then the data from overhead camera 14 is not modified, since it did not view the stem or blossom ends. On the other hand, if the data from side scan cameras 32, 34 indicates that the stem and blossom ends are not in their field of view, then the data provided by video camera 14 must be modified to eliminate the effects of stem end 66 and blossom end 68.

Figure 5:
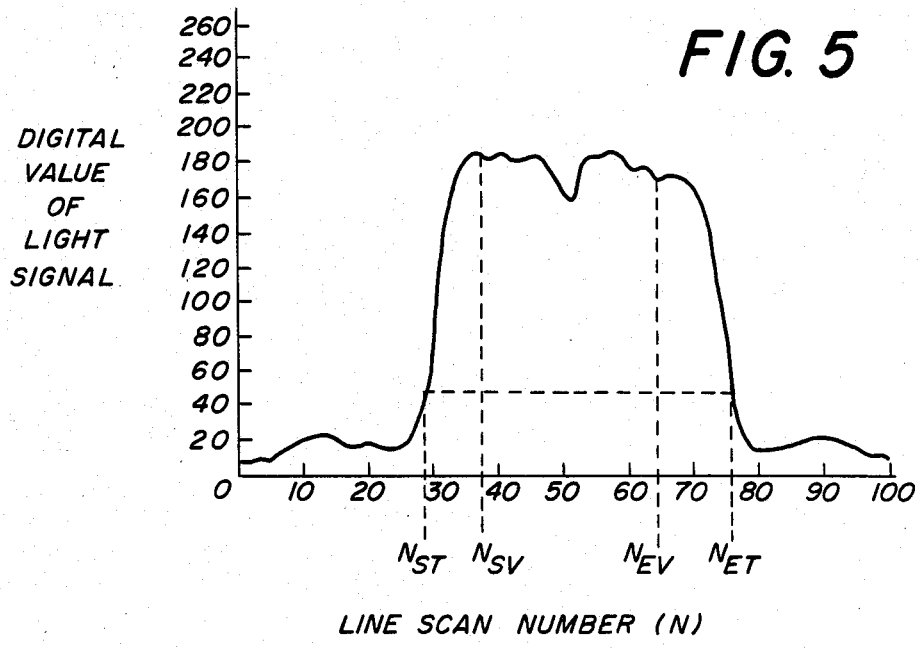
FIG. 5 is a plot of the digital output of one of the video cameras.
Figure 6:
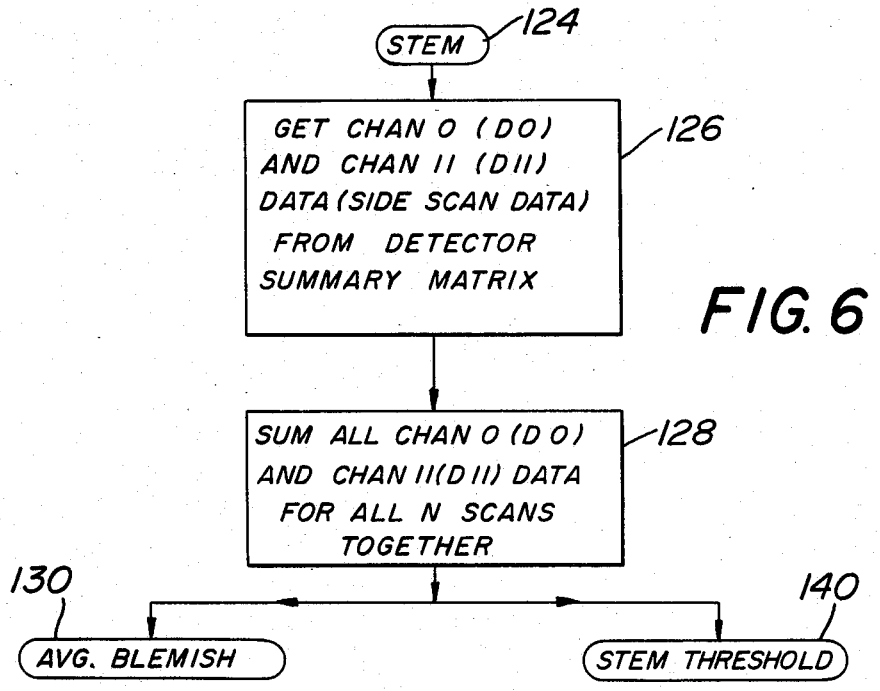
FIGS. 6–9 are flow charts illustrating the operation of the remaining portion of the inventive method.
Figure 7:
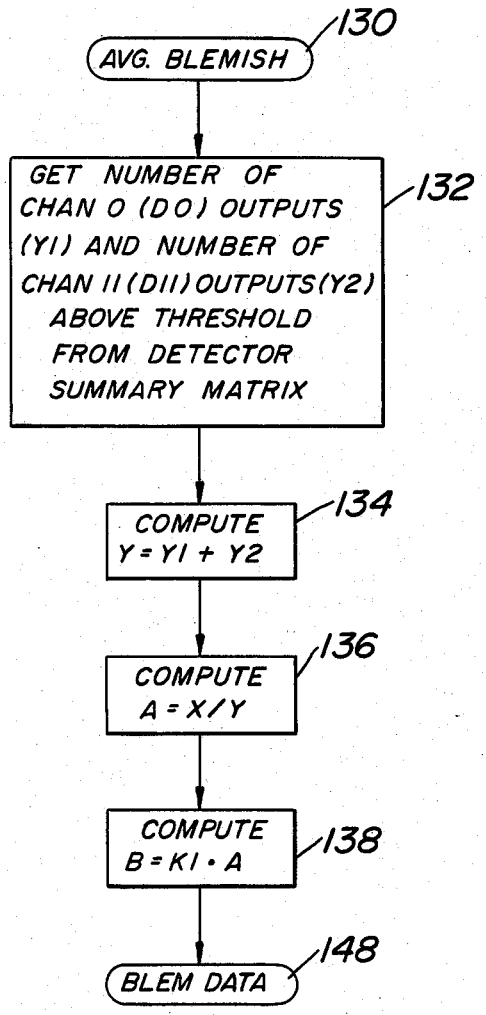
Figure 8:
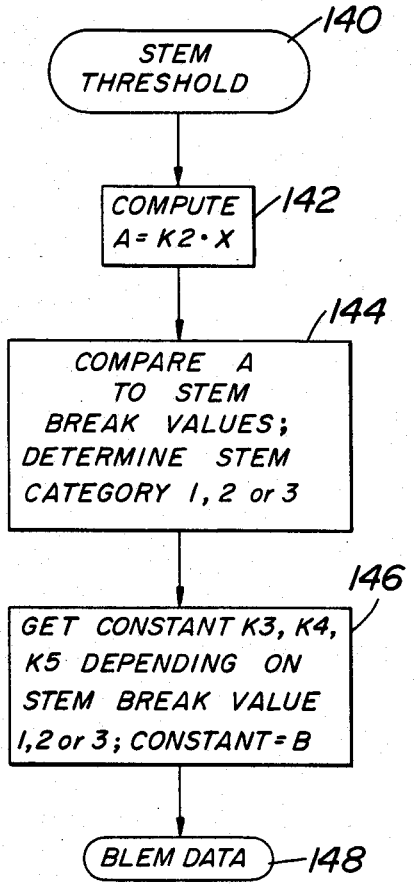

Referring now to FIG. 5, a typical output from one of the diodes D1–D10 is illustrated. It will be understood that FIG. 5 and the ensuing discussion also applies to the outputs from the side scan cameras 32, 34. As more fully explained in aforementioned U.S. patent application Ser. No. 430,068, before a fruit 36 enters the viewing area of overhead camera 14, and hence before it enters the viewing area of side scan cameras 32, 34, the digital value of the reflected light signal (as received by diodes D1–D10 and side scan cameras 32, 34 and converted to a digital signal by analog to digital converter 75) is relatively quiet. See, e.g., line scan numbers N=0–27. However, as shown in FIG. 5, at roughly the 28th line scan of the fruit surface, the diode output begins to rise significantly. This event is indicative of a fruit entering the viewing area and is identified as a start threshold, $N_{ST}$. Thus, in the example of FIG. 5, the value of $N_{ST}$ is 28. Similarly, as the fruit leaves the viewing area, the digital value of the reflected light signal begins to decrease significantly. See, e.g., light scan numbers 77–100. This event is identified as the end threshold, $N_{ET}$. In the example, the value of $N_{ET}$ is 76. In a preferred embodiment, the digital value of the light signal corresponding to $N_{ST}$ and $N_{ET}$ is empirically selected at 50 (See FIG. 5). Thus, at the 28th scan, the digital value of the light signal exceeded 50 and at roughly the 76th scan the digital value of the light signal fell below 50. Again, as explained more fully in aforementioned U.S. patent application Ser. No. 430,068, the digital data corresponding to the scans $N_{ST}$ and $N_{ET}$, inclusive, is processed to provide a value indicative of the surface quality of the fruit, and particularly blemish. Specifically, a computer is programmed to determine the first scan $N_{SV}$ where the digital value of the light signal falls below the value for the previous scan $N_{SV-1}$ and the last scan $N_{EV}$ where the digital value for the next scan $N_{EV+1}$ is greater than that for scan $N_{EV}$. That is, the scan numbers N where a decrease in light intensity is detected, such as would be due to a blemish, are determined. The number of scans where such decreased light intensity is detected is indicative of the size of the blemish.

The aforementioned discussion also applies to the side scan cameras 32, 34. If a substantial decrease in a reflected light intensity is detected anywhere between the scans $N_{ST}$ and $N_{ET}$, this is indicative of the stem and blossom ends 66, 68 being within the field of view of the side scan cameras 32, 34. However, as will be discussed, this could also be indicative of a blemish in the vicinity of the stem or blossom ends.

The overall processing method for processing the data from diodes D1–D10 is explained in detail in aforementioned U.S. patent application Ser. No. 430,068. However, the processing routine will be briefly repeated herein.

The processing routine is illustrated in FIG. 4 and may be carried out by a single microcomputer. However, in the preferred embodiment, the steps within the block 80 are carried out by a first computer 80 and the steps within the block 82 are carried out by a second computer 82. In the preferred embodiment, an Intel 8088 microprocessor is employed for each of the computers 80, 82.

As explained in the aforementioned pending patent application, batch digital data is stored in a memory unit of computer 80 for an entire surface scan of the fruit 36. Upon entering the routine illustrated in FIG. 14, control starts at 100 and immediately passes to block 101 where a counter D, used to retrieve the digital data stored in memory for each of the channels 0–11, is set to correspond to channel 0. Thus, it will be appreciated that when the counter is set to channel 0, it is processing data for all N scans of side scan camera 32, and when the counter is set to channel 11, it is processing data for all N scans of side scan camera 34. When the counter is set to any of channels 1–10, inclusive, it is processing data for all N scans of one of the diodes in the linear diode array 76.

At block 102, the software determines, for each channel, the start threshold, $N_{ST}$, the start value $N_{SV}$, the end threshold $N_{ET}$ and the end value $N_{EV}$. Reference is made to FIG. 5 which illustrates these previously defined scan numbers. As can be seen, and as more fully explained in the aforementioned pending patent application, it is necessary to perform a batch operation on all of the data (all N scans) for a given diode in order to determine, for example, $N_{EV}$. The threshold values $N_{ST}$ and $N_{ET}$ are calculated by comparing each data signal corresponding to a portion S on the fruit, with a predetermined threshold level, i.e., 50, as previously explained. Data outside the thresholds is not utilized for analysis of surface quality, e.g., blemish. All data, however, between the thresholds $N_{ST}$ and $N_{ET}$ is utilized even though there may be data signals within that range which drop below the threshold, e.g., due to blemishes. $N_{SV}$ is obtained at a subroutine of block 102 by comparing each discrete byte, or data signal for a given channel following the start threshold $N_{ST}$ with the prior data signal, and determining if there has been a decrease in value. $N_{EV}$ is also determined by a subroutine of block 102 which inspects the data signals, or bytes going backwards from $N_{ET}$, i.e., each prior signal is successively examined to see when its value decreases to a level less than the value of the immediately succeeding data signal.

After software has performed the operations of blocks 102 corresponding to a given channel, a check is made at block 104 to determine if the value of counter D is greater than 11, i.e., whether all of the channels have been analyzed. Assuming D is not greater than 11, the software next performs the steps indicated at block 106 entitled "Compute and Store". For the channel D=0–11 that has just been analyzed, the difference between $N_{ET}$ and $N_{ST}$ is determined at block 106, and stored in assigned storage space designated at block 107 as "Detector Summary Matrix". Between the start and end values $N_{SV}$ and $N_{EV}$, each data signal is compared with the next succeeding signal, and the absolute difference therebetween is generated. The absolute differences are summed throughout the range between the start and stop values at block 106 and stored in assigned spaces of the detector summary matrix 107. Thus, for the channel 0–11 being operated on, there is obtained a summation of the absolute differences of successive pairs of signals, which differences represent contrast between adjacent surface portions of the item. The summation is thus a representation of the surface quality, or amount of blemish as seen by the diode associated with the corresponding channel 0–11. As alternative or additional embodiments, the absolute differences may also be squared and stored or compared with a threshhold and stored if the threshold is exceeded, as a further indication of blemish.

In an alternative embodiment, the processing is varied as shown at 102A to determine the number of channels which show at least one byte above the threshold $N_{ST}$ and $N_{ET}$. This is desirable on applications where an indication of shape is obtained.

After the difference summation of block 106 has been performed, the program loops back to block 109 where the channel counter D is incremented so that the diode output corresponding to the next channel is processed. When the channel counter becomes greater than 11, which is determined at block 104, surface quality processing (blemish data acquisition) is completed and the program branches to perform the operations shown at block 112. The operations performed at block 112 pertain to the color of the fruit and are not relevant to the present invention. The details associated with blocks 112 and 113 are fully explained in aforementioned U.S. patent application Ser. No. 430,068.

At block 116, a number of operations are performed. Only the operations relevant to the present invention are explained herein. The remaining operations are explained in aforementioned U.S. patent application Ser. No. 430,068. The sums of the absolute differences for the diodes corresponding to channels 1–10 are examined and the largest one is taken and stored as an indication of blemish. In the alternative, any given fraction of the diode sums is accumulated to obtain the blemish figure. As a further alternative, the average of the absolute differences may be determined and stored to obtain a blemish figure. For the data corresponding to channels 0 and 11, a "stem detection routine" 124 is executed. The stem detection routine is illustrated in FIGS. 6–9 and will be explained in detail hereinafter. In summary, the stem detection routine modifies the blemish data provided by the detector summary matrix 107 for diodes D1–D10 to account for the orientation of the fruit as detected by side scan cameras 32, 34. The modified data is stored in the fruit summary matrix 117. After performing the operations indicated in block 116, the software compares the values stored in the fruit summary matrix 117 with predetermined break data. As indicated at block 120, break inputs can be entered through an operator console in conventional fashion. The break inputs represent levels according to which it is desired to sort, as more fully explained in U.S. patent application Ser. No. 430,083. As is known in the art, if it is desired to sort in accordance with N grades of classification, N−1 break values must be supplied against which the fruit signal is compared. Such classification comparisons are done as indicated at block 119, for volume, blemish, shape, color, varigation, or any combination thereof, again as more fully explained in U.S. patent application Ser. No. 430,068. Following such classification, output delivery signals are generated as indicated in block 122 and connected to output relays associated with discharge stations, in well-known fashion. Reference is made to U.S. Pat. No. 4,106,628 which illustrates the generation of classifying or sorting signals by comparing process data signals with break values and generating therefrom signals for proper sorting of fruit at a downstream location.

The stem detection routine 124 is illustrated in FIGS. 6–9. As previously indicated, the stem detection routine 124 is executed for data corresponding to channels 0 and 11, i.e., for data corresponding to side scan cameras 32, 34. Thus, at block 116, control is passed to the stem detection routine 124 to perform predetermined operations on the data corresponding to channels 0 and 11.

At the first block 126 of the stem detection routine 124, the sums of the absolute differences corresponding to channels 0 and 11, (previously computed at block 106), are retrieved from the detector summary matrix. Control then passes to block 128 where the channel 0 and channel 11 difference summation data is added together. A variable X is assigned to result of this addition.

Control then next passes to one of two routines, either the average blemish routine 130 or the stem threshold routine 140. In the preferred embodiment of the present invention, both routines are programmed into the microcomputer 82 and the user selects which of the routines will be used to process the data from the side scan cameras 32, 34.

If the user has selected the average blemish routine 130, control next passes to block 132 which retrieves from the detector summary matrix 107 the number of channel 0 outputs and the number of channel 11 outputs which exceeded the empirically chosen threshold, i.e., the number of scans between $N_{ST}$ and $N_{ET}$ for channels 0 and 11. The number of scans above the threshold value may be mathematically expressed as $N_{ET}-N_{ST}$.

A variable Y1 is assigned to the value of $N_{ET}-N_{ST}$ for channel 0, and a variable Y2 is assigned to the value of $N_{ET}-N_{ST}$ for channel 11. Control then passes to block 134 where the values Y1 and Y2 are added together. A variable Y is assigned to the resulting value, i.e., Y=Y1+Y2. Thus, the value assigned to the variable Y may also be expressed as:

$$Y=(N_{ET}-N_{ST})_{CHAN\ 0}+(N_{ET}-N_{ST})_{CHAN\ 11}$$

Control then passes to block 136 where the value of X (as computed at block 128) is divided by the value of Y (as computed at block 134). A variable A is assigned to the result, i.e., A=X/Y. It will be appreciated that the value of A is actually an average value of the photodiode outputs between $N_{SV}$ and $N_{EV}$ provided by side scan cameras 32 and 34. Control then passes to block 138 where the average value A is modified according to a constant K1. The value of constant K1 is a normalizing constant which is provided to account for differences in the time that the overhead camera 14 and the side scan cameras 32, 34 view the fruit. In the preferred embodiment, a typical value of constant K1 is 2.5–3.0. A variable B is assigned to the modified average value K1×A, i.e., B=K1×A. Control then passes to the blemish data routine 148 which will be explained hereinafter.

Instead of selecting the average blemish routine 130, the user could have selected the stem threshold routine 140. When the stem threshold routine 140 is selected, control immediately passes to block 142. At block 142, the value of X (as computed at block 128) is modified by multiplying it by a constant K2. A variable A is assigned to the result, i.e., A=K2×X. The constant K2 is also a normalizing constant which is provided simply for the user's convenience to scale the value of X to a value falling between 0 and 100 units. This is to enable the user to easily correlate the value of X to stem break values, as will be discussed in connection with block 144. When control passes the block 144, computer 82 compares the value of A to plural stem break values which define plural stem categories. In the preferred embodiment, the user selects two stem break values which, it will be appreciated, define three stem breaks or categories. The user assigns a value of 0 to 100 for each of the two stem break values. Thus, for example, the user could assign a value of 33 to the first stem break value and a value of 66 to the second stem break value thereby defining three stem breaks or categories, i.e., category one covers the range 0–32, category two covers the range 33–65 and category three covers the range 66–100. It will be appreciated, however, that although only three stem breaks are shown herein, any desired number of stem breaks could be provided.

As previously explained, the value of A is also a value falling between 0 and 100 units, due to normalization by the constant K2. Thus, at a block 144, a stem category 1, 2 or 3 is chosen depending upon which one of the stem breaks the value of A falls into. Utilizing the above example, if the value of A is 63, it would fall into the second stem break, i.e., the stem break category would be 2.

Control then passes to block 146 where, depending on the stem break into which the value A has been categorized, a constant K3, K4 or K5 is selected. For example, if the value of A fell into stem category 1, constant K3 would be selected. If the value of A fell into category 2, constant K4 would be selected and if the value of A fell into stemn category 3, constant K5 would be selected.

The values of K3, K4 and K5 are used to modify the preliminary indication of surface quality or blemish (i.e., the blemish figure stored in the fruit summary matix 117 which was computed according to data provided by overhead camera 14). Selection of the constant K3 corresponds to the case where fruit 36 is oriented so that the stem and blossom ends are not in the field of view of side scan cameras 32, 34, but are in the field of view of overhead camera 14. Thus, in this case, it is desired to modify the preliminary blemish figure to compensate for the stem and blossom ends which the overhead camera 14 processed as a blemish. In the preferred embodiment, the value of K3 is assigned a value in the range from −1 to −10.

If the value of A fell into the second stem break category, constant K4 is selected. Selection of the constant K4 corresponds to the case where the fruit 36 was oriented so that its stem and blossom ends are in the field of view of the side scan cameras 32, 34. Thus, it will be appreciated that when the fruit is oriented so that the side scan cameras 32, 34 "see" the stem and blossom ends, they will produce digital data which results in the value K4 being selected. In the preferred embodiment, the value of K4 is 0. Thus, as will be seen, when K4 is selected, the blemish data is not modified since the overhead camera did not view the stem and blossom ends of the fruit and hence did not mistake them for a blemish.

If the value of A falls into the last or third stem break, constant K5 is selected. Selection of constant K5 corresponds to the case where the side scan cameras 32, 34 not only viewed the stem and blossom ends of the fruit, but also viewed a blemish. Thus, selection of constant K5 corresponds to the case where fruit is oriented so that the overhead camera 14 did not view the stem or blossom ends of the fruit, and there is a blemish on the stem or blossom end of the fruit which the overhead camera 14 did not view but which the side scan cameras 32, 34 did view. In such a case, it is desirable to modify the blemish figure computed in FIG. 4 to compensate for this additional blemish which the overhead camera 14 did not view. In the preferred embodiment, the value assigned to the constant K5 is in the range from 1 to 10.

As shown at block 146, a variable B is assigned to the value of the selected constant K3, K4 or K5. Control then passes to the blemish data routine 148.

Figure 9:
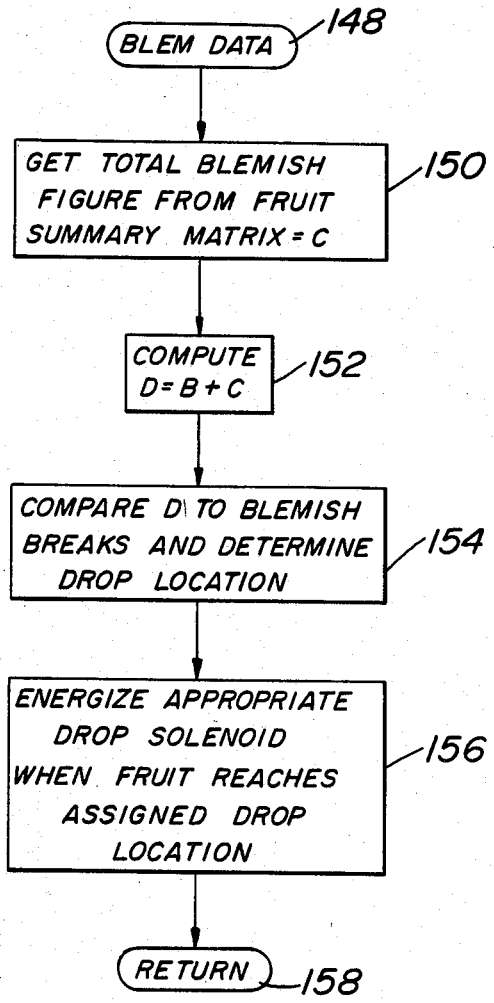

The blemish data routine 148 is illustrated in FIG. 9.

After execution of the appropriate one of the average blemish routine 130 or the stem threshold routine 140 is completed, control passes to the blemish data routine 148. At the first block 150 of the blemish data routine 148, the preliminary blemish figure stored in the fruit summary matrix 117 (computed in the routine illustrated in FIG. 4) is retrieved. A variable C is assigned to the value of the preliminary blemish figure. Control passes to block 152 where the blemish figure is modified according to the value of variable B. It will be recalled that a value of B was computed in the average blemish routine 130 at block 138 and in the stem threshold routine 140 at block 146. It will be appreciated that if the fruit is oriented with its stem and blossom ends within the field of view of side scan cameras 32, 34, and there is no blemish on the stem or blossom end, little or no modification to the blemish figure C will occur since K4=0 in the case of stem threshold routine 140 and the value of A will be approximately 0 in the case of average blemish routine 130. However, if the side scan cameras 32, 34 did not view the stem and blossom ends of the fruit, the blemish figure C will be modified by adding thereto the value of B (K3 in the case of stem threshold routine 140). If side scan cameras 32, 34 viewed both the stem and blossom and a blemish, the blemish figure C will also be modified by adding the value of B thereto (K5 in the case of the stem threshold routine 140). A variable D is assigned to the new or modified blemish figure, i.e., D=B+C.

Control then passes to block 154 where the modified blemish data D is compared to the blemish breaks, as also shown at block 118 in FIG. 4. At block 156 the appropriate drop solenoids are activated when the fruit reaches its assigned drop location, as explained in more detail in U.S. Pat. No. 4,106,628.

At block 158, control is returned back to the algorithm of FIG. 4 which is repeated for the next fruit to be examined.

It will be appreciated that the foregoing apparatus and method provides a unique yet simple way of determining the orientation of spherical, non-orienting fruit and for modifying blemish data to account for the orientation of the fruit. The specific program steps used to implement the present inventive method may be provided using well-known programming techniques. The method requires only a minimum of memory and a minimum of processing time.

The present invention may be embodied in other specific forms without departing from the spirit or essential attributes thereof and, acordingly, reference should be made to the appended claims, rather than to the foreagoing specification, as indicating the scope of the invention.

What is claimed is:

1. Apparatus for processing items such as fruit and the like comprising:

(a) first means for examining a substantial portion of the surface of the item and developing a plurality of discrete data signals representative of a surface condition of the item;

(b) second means for examining only selected portions of the surface of the item not examined by the first means and developing discrete data signals representative of the orientation of the item being examined by the first means;

(c) third means for generating preliminary process data representative of the condition of the item's surface examined by the first means based upon the plurality of data signals developed by the first means and for modifying the preliminary process data to account for the orientation of the item while examined by the first means based upon the plurality of data signals developed by the second means and thereby provide final corrected process data representative of the surface condition of the item.

2. Apparatus according to claim 1 further comprising:

(a) means for transporting the item past the first and second means;

(b) means for discharging the item at a selected one of a plurality of discharge stations based upon the modified process data for the item.

3. Apparatus according to claim 2 wherein the first means comprises a linear photodiode array disposed overhead the path of travel of the item and each diode in the array corresponds to a discrete portion of the surface of the item and provides a data signal representative of a surface condition of the corresponding surface portion of the item.

4. Apparatus according to claim 3 wherein the second means comprises a pair of photodiodes, the photodiodes being arranged to view selected surface portions of opposite sides of the item and provide data signals representative of surface conditions of the selected portions.

5. Apparatus according to claim 4 wherein the third means comprises:

(a) multiplexing means receiving the data signals from the linear photodiode array and from the pair of photodiodes for presenting a selected one of the data signals at the output thereof;

(b) analog to digital conversion means operatively coupled to the multiplexing means for converting the data signal presented at the output of the multiplexing means to a digital signal;

(c) microcomputer means operatively coupled to the analog to digital conversion means and to the discharging means for receiving and accumulating the digital signals, computing an indication of surface quality of the item corrected according to the orientation of the item and supplying actuating signals to the discharging means to discharge the item at a selected one of the discharge stations.

6. Apparatus for sorting generally spherical articles according to a surface condition comprising:

(a) a roller conveyor simultaneously transporting and spinning an article to be sorted;

(b) a light source and optics for illuminating the article;

(c) a first video camera having a field of view which is in a plane perpendicular to and intersected by the path of the article, the first video camera being disposed overhead the article at a location to receive light reflected from portions of the surface of the article that intersect the plane, the first video camera comprising a linear photodiode array providing a plurality of data signals, each data signal having a value representative of a surface condition of a respective portion of the article;

(d) second and third video cameras having fields of view which are in the same plane as the field of view of the first video camera, the second and third video cameras being disposed adjacent to and on opposite sides of the roller conveyor at locations to receive light reflected from portions of the surface of the article that interest the plane and that are substantially perpendicular to that horizontal axis of the article that is perpendicular to the direction of travel of the article, the second and third video cameras each comprising a photodiode providing data signals having values representative of a surface condition of the portion of the article surface viewed by the second and third video cameras;

(e) a multiplexer receiving and scanning the data signals and providing a multiplexed video output signal;

(f) an analog to digital converter receiving and converting the video output signals to digital data signals;

(g) a processor receiving the digital data signals from the analog to digital converter and supplying control signals to the multiplexer and analog to digital converter, the processor accumulating the digital data signals corresponding to the first, second and third video cameras, computing, according to a predetermined algorithm, a preliminary indication of surface quality of the article based upon the accumulated digitial data provided by the first video camera, and modifying, according to a predetermined algorithm, the preliminary indication of surface quality to provide a final corrected indication of surface quality based upon the accumulated digital data provided by the second and third video cameras; and (h) a plurality of discharge stations for discharging the article from the roller conveyor from a selected location according to the final indication of surface quality.

7. A method of sorting articles according to surface quality comprising the steps of:

(a) electronically scanning a substantial portion of the surface of the article and providing a first numerical value preliminarily representative of the surface condition of the article;

(b) electronically scanning only portions of selected side surfaces of the article not scanned in step (a) and providing a second numerical value representative of the surface condition of the selected side surfaces;

(c) selectively modifying the magnitude of the first numerical value by an amount dependent upon the magnitude of the second numerical value to account for the orientation of the article as scanned in step (a);

(d) classifying the article into one of a plurality of categories depending upon the magnitude of the modified first numerical value;

(e) determining which one of a plurality of discharge stations should receive the article based upon the category into which the article has been classified; and (f) discharging the article at the discharge station determined to receive the article.

8. An article sorting machine comprising:

(a) an examining region through which articles to be sorted are transported;

(b) scanning means disposed adjacent said examining region for photoelectrically scanning the surface of the articles transported through the examining region;

(c) detection means disposed adjacent the examining region for detecting whether selected portions of the surface of the articles are within the field of view of the scanning means, the detection means comprising video camera means aimed into the examining region so as to view portions of the surface of the article not within the field of view of the scanning means; and (d) processing means receiving and procesing video signals generated by the video camera means for determining whether the selected portions are within the field of view of the scanning means, the video signals having magnitudes exceeding a preselected threshold level when the portions viewed by the video camera means are the selected portions of the surface of the article, thereby providing an indication that the selected portions of the article are not within the field of view of the scanning means.

9. Apparatus according to claim 8 wherein the article is a fruit and the selected portions are stem and blossom ends of the fruit, the scanning means being disposed overhead the examining region and having a substantially downward field of view, the fruit being spun about a horizontal axis defining a spin axis as it passes through the examining region, the video camera means being disposed adjacent the examining region at an acute angle with respect to the spin axis and focused upon surface areas of the fruit substantially perpendicular to the spin axis.

10. Apparatus according to claim 9 wherein the scanning means comprises a linear photodiode array, each photodiode in the array corresponding to segmental areas of the fruit and providing video signals having magnitudes representative of surface conditions of the corresponding segmental areas of the fruit, the processing means receiving the video signals from the photodiodes and comprising a microcomputer programmed to compute a first process data word having a value based upon the magnitudes of the video signals supplied by the photodiodes, a second process data word having a value based upon the magnitudes of the video signals supplied by the video camera means, and a third process data word having a value based upon a combination of the first and second process data words, the value of the third process data word being a representation of the overall surface quality and corrected according to the orientation of the stem and blossom ends of the fruit.

11. Apparatus according to claim 8 wherein the processing means further receives video signals generated by the scanning means and comprises a microcomputer programmed to compute a first process data word based upon video signals supplied by the scanning means, a second process data word based upon video signals supplied by the video camera means and a third process data word based upon a combination of the first and second process data words.

12. Apparatus according to claim 8 wherein the scanning means comprises a linear photodiode array, each photodiode in the array corresponding to selected segmental areas of the surface of the article and providing video signals having values representative of surface conditions of the corresponding segmental areas of the article.

13. Apparatus for sorting generally spherical fruit of the type having stem and blossom ends comprising:

(a) first means for simultaneously transporting the fruit through an examining region and spinning the fruit about a horizontal axis defining a spin axis;

(b) second means disposed overhead the examining region and having a substantially downward field of view for optically scanning portions of the surface of the fruit in the field of view of the second means, the second means comprising a linear photodiode array, each photodiode corresponding to segmental areas of the surface of the fruit, the second means providing plural first data signals having values representative of surface conditions of corresponding segmental areas of the fruit;

(c) third means disposed adjacent the examining region for optically scanning portions of the surface of the fruit not in the field of view of the second means, the third means comprising a pair of video cameras aimed into the examining region at an acute angle with respect to the spin axis so as to view portions of opposing side surfaces of the fruit which are substantially perpendicular to the spin axis, the third means providing plural second data signals having values representative of surface conditions of the side surfaces;

(d) fourth means receiving and processing the plurality of first and second data signals and computing first and second process data words based upon the collective values of the first and second data signals, respectively, and computing a third process data word having a value based upon a combination of the values of the first and second process data word, the value of the third process data word being an indication of the surface quality of the fruit which is corrected according to the orientation of the stem and blossom ends of the fruit; and (e) fifth means operatively connected to the fourth means for discharging the fruit at one of a plurality of discharge locations according to the computed surface quality of the fruit.

* * * * *